US006149875A

United States Patent [19]

Rao et al.

[11] Patent Number: 6,149,875

[45] Date of Patent: Nov. 21, 2000

[54] FLUIDIZED CATALYTIC CRACKING PROCESS AND APPARATUS

[75] Inventors: Marri Rama Rao; Vutukuru Lakshmi Narasimha Murthy; Sanjeev Singh; Asit Kumar Das; Sobhan Ghosh; Debasis Bhattacharyya, all of Faridabad; Satish Makhija, New Delhi; Sukumar Mandal, Faridabad, all of India

[73] Assignee: Indian Oil Corporation, Limited, Mumbai, India

[21] Appl. No.: 09/219,459

[22] Filed: Dec. 23, 1998

[51] Int. Cl.[7] ..... B01J 8/26

[52] U.S. Cl. ..... 422/144; 422/141; 422/145; 422/146; 422/147

[58] Field of Search ..... 422/139–147

[56] References Cited

U.S. PATENT DOCUMENTS

| | | | |
|---|---|---|---|
| 4,064,038 | 12/1977 | Vermilion, Jr. | 208/164 |
| 4,787,967 | 11/1988 | Herbst et al. | 208/74 |
| 4,814,068 | 3/1989 | Herbst et al. | 208/155 |
| 4,875,997 | 10/1989 | Langford | 208/235 |
| 4,892,643 | 1/1990 | Herbst et al. | 208/70 |
| 4,895,636 | 1/1990 | Chen et al. | 208/113 |
| 4,904,281 | 2/1990 | Raterman | 422/144 |
| 4,927,522 | 5/1990 | Herbst et al. | 208/120 |
| 4,971,766 | 11/1990 | Chen et al. | 422/144 |
| 5,059,302 | 10/1991 | Weinberg et al. | 208/91 |
| 5,110,775 | 5/1992 | Owen | 208/113 |
| 5,196,172 | 3/1993 | Weinberg et al. | 422/144 |

OTHER PUBLICATIONS

Bergmann/Schäfer: Lehrbuch der Experimentalphysik [Textbook on Experimental Physics], vol. 6, 1992, pp. 452 et seq.

*Primary Examiner*—Hien Tran

*Attorney, Agent, or Firm*—Venable; George H. Spencer; Ashley J. Wells

[57] ABSTRACT

A fluidized catalytic cracking apparatus includes a riser containing a regenerated catalyst and adsorbant, and has a first inlet for introduction of high velocity steam, a second inlet for introduction of a feed stream containing heavy residual fractions with high concentrations of conradson coke, metals including vanadium and nickel, and additional poisons including nitrogen, a third inlet for introduction of an adsorbent, and a fourth inlet disposed above the third inlet means for introduction of a regenerated catalyst, the adsorbent having a particle size which is larger than that of the regenerated catalyst. A stripper is provided into which the riser extends for causing separation of a hydrocarbon fraction from spent catalyst and adsorbent, and a separator is connected to the stripper and has a base, an inlet at the base for introduction of steam in the upward direction so as to provide a transport velocity in the upward direction for the spent catalyst and cause a separation of the particles of the spent catalyst from the adsorbent in use. A regenerator is connected to the separator and has an outlet and is in flow communication with the fourth inlet for introduction of the regenerated catalyst into the riser. A burner is provided for receiving the adsorbent from the separator and for causing a regeneration thereof, the burner having an inlet for introduction of oxygen containing gas and an outlet in flow communication with the third inlet for introduction of the adsorbent into the riser. A lift line is connected between the separator and the regenerator for allowing a flow of the spent catalyst from the separator into the regenerator while leaving the adsorbent within the separator in a fluidized condition the lift line having a plurality of steam inlets disposed at different elevations along its length for introduction of steam to provide said transport velocity.

5 Claims, 2 Drawing Sheets

FLUIDIZED CATALYTIC CRACKING PROCESS AND APPARATUS

BACKGROUND OF THE INVENTION

1. Field of the Invention

This invention relates to a fluidized catalytic cracking (FCC) process for converting heavy vacuum gas oil and residual oil fractions into lighter products and to an apparatus therefor.

2. Description of the Related Art

Fluid Catalytic Cracking (FCC) is one of the important processes used in petroleum refineries for converting heavy vacuum gas oil into lighter products namely gasoline, diesel and liquefied petroleum gas (LPG). Processing of heavy residues e.g. atmospheric and vacuum bottoms are increasingly being practiced in the FCC Unit for enhanced conversion of residue. Heavy residues contain higher amount of conradson carbon residue CCR, poisonous metals e.g. sodium, nickel, vanadium and basic nitrogen compounds etc., all of which have significant impact on the performance of FCC unit and the stability of its catalyst.

The high CCR of the feed tends to form coke on the catalyst surface which in turn brings down its activity and selectivity. Moreover, the higher deposit of coke on the catalyst increases the regenerator temperature and therefore catalyst/oil ratio reduces for heat balanced FCC unit. The FCC catalyst can tolerate a maximum temperature of up to 750° C., which limits the CCR of feed that can be processed in FCC. At present, FCC with two stage regenerators and catalyst coolers can handle up to 8 wt % feed CCR economically.

Nickel, vanadium and sodium are also available in large quantity in the residual feed. The poisoning effects of these constituents are well known in the FCC art. In the past, there have been some efforts to passivate the damaging effects of nickel and vanadium on the catalyst. These efforts have resulted only with some success in the passivation of nickel. Thus, by the known methods, it is presently possible to handle up to some 30 ppm of nickel on the feed and up to 10,000 ppm nickel on the equilibrium catalyst. Similarly, with the known processes, vanadium up to only 15 ppm on feed and 5000 ppm on the equilibrium catalyst can be handled economically. These above limits provide a serious problem of residue processing capability of FCC unit. As such, huge quantity of metal laden equilibrium catalyst are withdrawn from residue FCC unit to keep the circulating catalyst metal level within the tolerable limit. As regards the basic nitrogen compounds, suitable passivation technology is yet to be found.

In addition to the developments of passivation technologies, there have been some important design changes made for efficient residue processing. One such design change is the two stage regeneration instead of a single stage regeneration. U.S. Pat. No. 4,064,038 describes the advantages of two stage regenerator and its flexibility to handle additional feed CCR without requiring catalyst cooler. However, even with the two stage regenerator of U.S. Pat. No. 4,064,038, there is a limitation to increase feed CCR above 4.5 wt % and vanadium above 15–20 ppm on feed.

It has been suggested in the art to use a separable mixture of catalyst and inert solid particles for processing of resid. Thus, U.S. Pat. Nos. 4,895,637 and 5,110,775 suggest a physically separable mixture of FCC catalyst and vanadium additive having sufficient differences in their setting velocities so as to cover a segregation of the two types of particles in a single stage regenerator. Though such a process is simple, there are several practical disadvantages which limit its resid handling capability, namely (i) the regenerator is kept in the dense phase where the average superficial velocity is about 0.7 meter/second. At such a velocity level, the catalyst particles still possess considerable downward gravitational pull. Moreover, there is sufficient turbulence and mixing in the bed which leads to poor segregation efficiency.

(ii) It is known in the FCC art that vanadium is highly mobile in the regenerator atmosphere, and that in the single stage regenerator, the vanadium may escape from the additive to the catalyst particle. This defeats the basic purpose of catalyst/additive segregation.

iii) At lower velocity of dense bed regimen, larger particles of vanadium additive may not fluidize well.

Some of these issues have been addressed by Haddam et al. in U.S. Pat. No. 4,875,994 where combustor type two stage regenerator is proposed. High velocity combustion air is used to lift the catalyst particles from the combustor. However, the mobile vanadium vapors are allowed to move to the high temperature regenerator through lift line along with the catalyst which may cause considerable damage to zeolites in the catalyst particles. In addition, the downcomer line from the regenerator to the combustor may allow the separated catalyst particle to again get mixed with the additive.

U.S. Pat. No. 4,814,068 discloses a multistage process with three sets of intermediate riser, U bend, mixing and flue gas system. Such a system is used to separate large pore catalyst particle from those having intermediate pores. The particle size of the coarse particle is also very high (500–70000 microns) to avoid the carry-over of coarse particles to the second stage regenerator.

Similarly, U.S. Pat. No 4,892,643 and 4,787,967, also take up separation of particles of two very different sizes, one having 20–150 micron and the other 500–70,000 microns. The stripper section is made annular double stage where by the difference of setting velocity of the above two size range of particles are exploited.

U.S. Pat. Nos. 4,895,636 and 4,971,766 disclose a process and apparatus for contacting residue feedstock in the dense bed kept at the riser bottom before getting cracked by the catalyst in the riser. However, the major problem is the proper atomization of feed in the dense bed with large particles at low velocity. In addition, the system will be prone to more non selective thermal cracking in the dense bed below riser resulting in higher gas and coke make. Moreover, the feed CCR will also deposit on the catalyst and therefore, the CCR related problems of residue are not addressed.

U.S. Pat. No. 4,927,522 disclose another way of increasing the residence time of ZSM-5 additive in the riser cracking process. Here the riser is made with several enlarged regions and separate feed entry locations after each enlarged section.

The inventions of U.S. Pat. No. 5,196,172 and U.S. Pat. No. 5,059,302, claim of FCC process and apparatus employing a separable mixture of catalyst and sorbent particle. Here the sorbent particles are smaller in size (30–90 microns) and the catalyst particles are bigger in size (80–150 micron). The process employs selective vortex pocket classifier and horizontal cyclone type burner to continuously separate the two types of particles.

An object of this invention is to propose a fluidized cracking process for converting heavy vacuum gas oil and residual oil fractions into lighter products and an apparatus therefor.

SUMMARY OF THE INVENTION

According to this invention there is provided a fluidized catalyst cracking apparatus comprising a riser having a feed inlet for introduction of the feed stream containing heavy residual oil fractions with high concentrations of conradson coke (CCR), metals such as vanadium, nickel and other poisons such as basic nitrogen, said riser having a first inlet for introduction of high velocity steam, a second inlet for introduction of the feed, a third inlet for introduction of an adsorbent, a fourth inlet for introduction of the regenerated catalyst, said riser extending into a stripper for causing a separation of hydrocarbon fraction from the spent catalyst and adsorbent, said stripper connected to a separator for causing a separation of the adsorbent, a burner in flow communication with said separator for receiving the adsorbent, a regenerator in flow communication with said separator for regenerating the catalyst separated in the separator, said burner having an outlet in flow communication with the third inlet for introduction of the adsorbent into said riser, said regenerator having an outlet, in flow communication with said fourth inlet for introduction of said regenerated catalyst into said riser.

Further according to this invention there is provided a fluidized catalytic cracking process for converting heavy vacuum gas oil and residual oil fractions into lighter products comprising in first contacting a heavy residue feedstock with an absorbent so that the impurities are deposited on the adsorbent in the bottom of a riser, allowing the feedstock and adsorbent to contact a catalyst so as to cause a cracking reaction, the catalyst and adsorbent being separated from the product hydrocarbons in a stripper, the mixture of catalyst and adsorbent being introduced into a separator for causing a separation of the spent catalyst and adsorbent, the spent adsorbent being introduced into a burner and the activated adsorbent recycled into said riser, the spent catalyst being regenerated in a regenerator and then introduced into said riser.

The present invention provides a fluidized catalytic cracking process and apparatus, wherein a heavy residue feedstock is first contacted with hot adsorbent particles at the riser bottom in presence of lift steam. The CCR, metals and other impurities of residue are first deposited on the adsorbent particles in the bottom part of the riser. Subsequently, the adsorbent and cleaned hydrocarbon mixture is contacted with hot regenerated FCC catalyst particles and the cracking reactions are accomplished in the remaining part of the riser. The catalyst and adsorbent particles are separated from the product hydrocarbons, stripped using counter current stripping and allowed to flow into the catalyst separator device.

The improvement in the present invention also consists of separating the catalyst particles in the separator using steam at relatively higher velocity but at moderately lower temperature, such that the adsorbent particles form a dense bed and the catalyst particles are transported to the top of the regenerator. The separator lift steam is separated from the ensuing catalyst using cyclone and the catalyst after separation is regenerated using oxygen containing gas and recycled to the said riser but at a level higher than the catalyst inlet. The adsorbent particles are withdrawn from the separator bottom and fed to the burner where partial or complete removal of coke is done using oxygen containing gas and the decoked adsorbent is recycled back to the said riser bottom. In accordance with an embodiment of this invention, a purge outlet is provided with the burner to withdraw a net stream of adsorbent particularly when heavy feed with high CCR is used. In such an embodiment, calcined coke is the preferred adsorbent and the net coke withdrawn from the purge outlet allows the residues with very high CCR to be processed without generating excess heat. Such net coke stream may be used as fuel in gasification unit or power plant or other suitable alternate usage.

The present invention also envisages a direct recycle of the adsorbent from the separator without having any separate burner. Also, a part of the regenerated catalyst may be circulated to the separator to increase the temperature to some extent. In addition, both the adsorbent and the catalyst may be cooled before being recycled to the riser using internal and external coolers if found economic.

DESCRIPTION OF THE PREFERRED EMBODIMENTS

Figure 1:
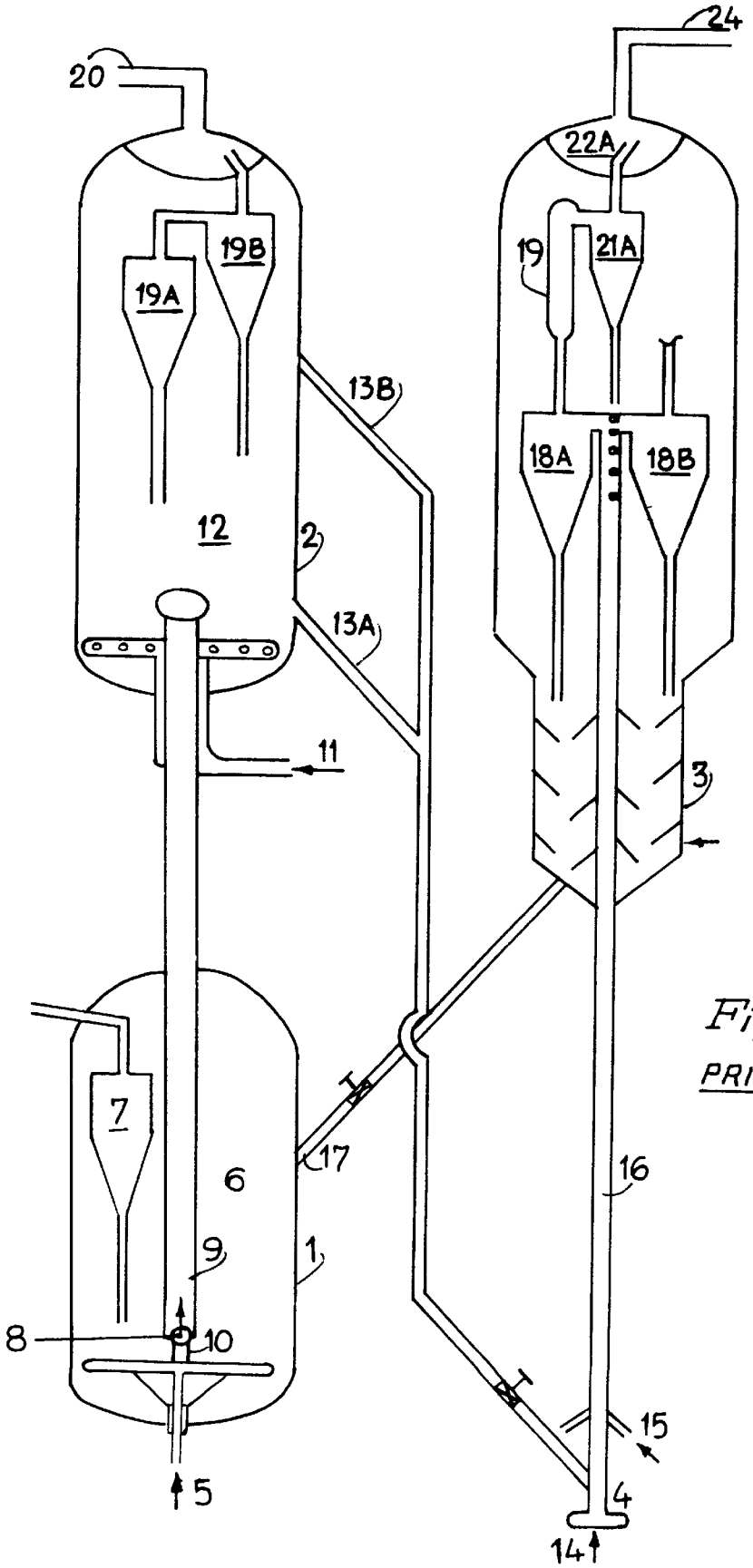
Fig. 1 PRIOR ART
FIG. 1 shows a FCC apparatus of the prior art with two stage regenerators, riser reactor with single stage annular stripper and where the entry of solid particles is at a single point in the riser.

The FCC regenerator vessel or regenerator 1 of FIG. 1 (prior art) receives spent catalyst from stripper 3. Combustion air 5 in the regenerator 1 is distributed at the bottom and catalyst dense phase 6 is maintained typically in partial combustion conditions at which the coke on the catalyst is partially burnt off using controlled amount air at moderate temperature. The flue gas of regenerator 1 is separated from the entrained catalyst by cyclone 7 or a series of cyclones. The partially regenerated catalyst is lifted from regenerator 1 to regenerator 2 at the top via lift line 9 by using lift air 8 and plug valve at 10. Secondary air 11 is distributed at the bottom of regenerator 2 such that the dense bed 12 is maintained and the catalyst is almost completely burnt off the coke below 0.1 wt %. The regenerated catalyst is withdrawn from line 13A having pressure equalizer 13B and fed to the bottom of the riser 4 with lift steam from inlet 14 and hydrocarbon feed injection 15 and the mixture of hydrocarbon and catalyst flow through the riser 16 followed by countercurrent steam stripping in the stripper 3. The stripped and spent catalyst flows back to regenerator 1 through pipe 17 for continuous regeneration and circulation. The product hydrocarbon at the riser end is separated from the catalyst using cyclone 18A, 18B, a connecting pipe 19, second stage reactor cyclone 21A, reactor plenum 22A and directed to product fractionator via transfer line 24. The flue gas of regenerator 2 is separated from the entrained catalyst by cyclone/series of cyclone 19A,19B and discharged through outlet 20.

Figure 2:
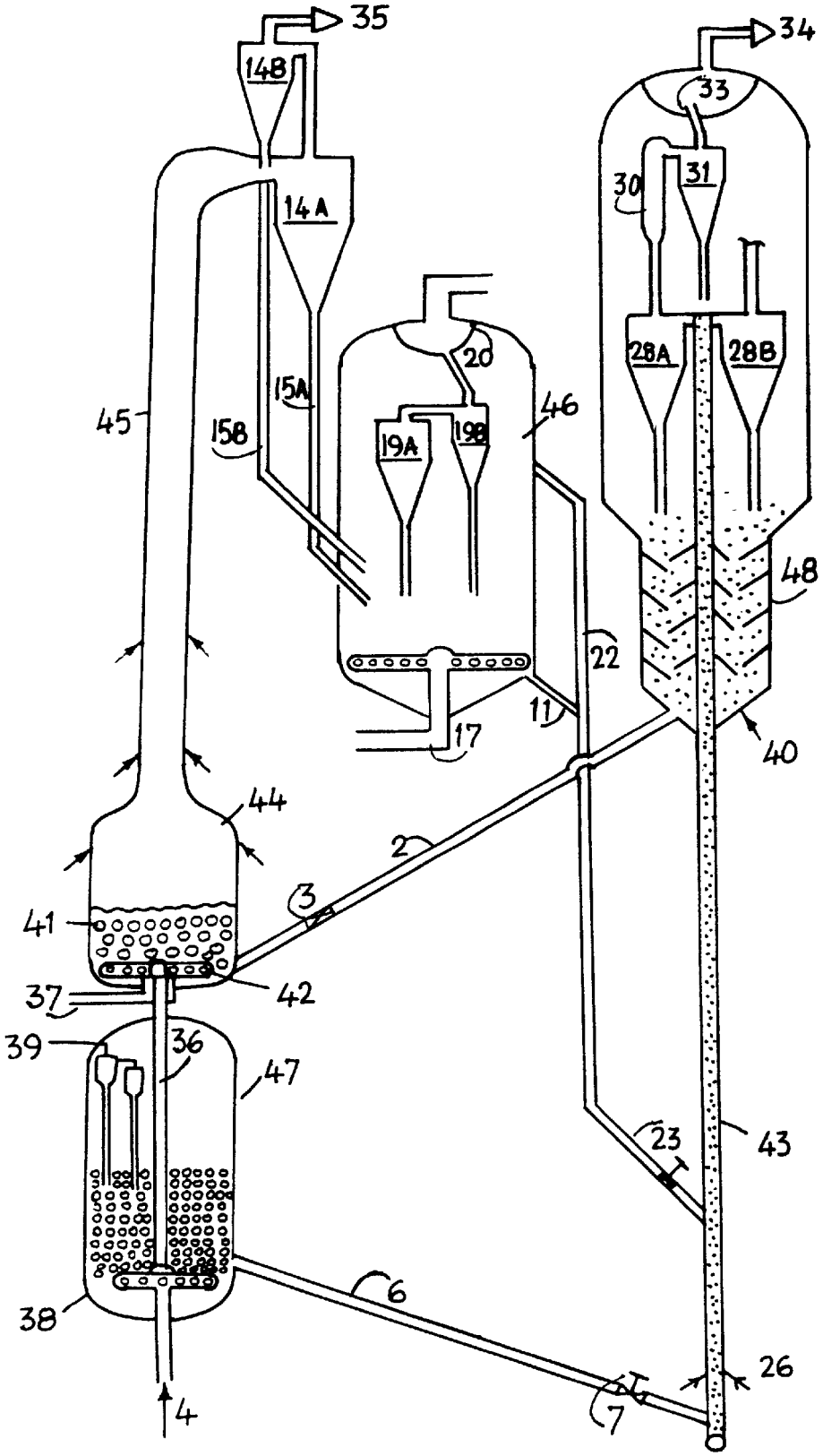
FIG. 2 shows a FCC apparatus of the present invention having a catalyst adsorbent separator device using high velocity steam at lower temperature and having single stage regenerator for catalyst, a burner for the adsorbent, riser reactor with at least two solid entry points, counter current stripper and other subsystems used in conventional FCC unit.

FIG. 2 illustrates the FCC apparatus of present invention where a separator 44 using steam is employed to transport the relatively lighter and finer catalyst particles to a regenerator vessel 46 after separating from the above said steam using cyclone(s) and relatively heavier and coarser catalyst particles from the dense bed from which the adsorbent is either directly recycled back to the riser bottom or could be partially or completely burnt off the coke in a coke burner before recycling to the riser bottom.

The apparatus of the present invention is illustrated in FIG. 2. The mixture of spent catalyst and adsorbent particles enter near the middle of a separator 44 via spent catalyst standpipe 2 and a valve 3. Steam introduced through pipe 37 is injected at the bottom of separator 44 to help maintain a dense bed 41 of the relatively heavier and coarser adsorbent particles. The superficial velocity in separator 44 is maintained sufficiently so that the relatively lighter and finer catalyst particles are transported to the top of a lift line 45 provided at the upper section of separator 44. Lift line 45 preferably has a reduced cross section than that of separator 44, and wherein steam is injected at different elevations to facilitate an easy transport of the catalyst particles. At the top of lift line 45, cyclones 14A,14B are employed to separate the catalyst from steam, which is recovered through outlet 35 and may be recycled at different sections of stripper 48 and riser reactor 43 such as at inlet points 25,26,40 or may be mixed with product hydrocarbons discharged from outlet 34. A purge outlet 38 is provided with burner 47 so as to withdraw a net stream of adsorbent on continuous basis particularly when the residue feed being processed contains very high CCR. The adsorbent in such an instance is preferably calcined coke particles, and a net stream of coke thus withdrawn helps to minimize the net heat generation in the system which allows the apparatus to operate with feed up to very high CCR level. In the instance where the feed CCR is very less, it may not be necessary to have a separate adsorbent burner. In such situation, the hot regenerated catalyst may be withdrawn from the regenerator via line 42 and mixed with adsorbent at the separator. It may noted that the separator temperature should be maintained within maximum 600° C. and preferably below 550° C. to achieve the best catalyst thermal and hydro thermal stability.

The catalyst flows through cyclone diplegs 15A,15B to regenerator 46 where air is injected through inlet 17 in controlled or in excess amount depending on the partial or complete combustion of the coke on the catalyst as felt necessary. A dense bed of catalyst particles is formed in regenerator 46 where the flue gas is separated using cyclone 19A,19B and allowed to flow via plenum 20 to the flue gas and power recovery section. The regenerated catalyst is withdrawn through line 11 with pressure equalizer 22 and recycled back to riser or riser reactor 43 at an intermediate riser elevation via pipe 23.

The adsorbent particles are withdrawn from separator 44 via downcomer 36 to adsorbent burner 47. Oxygen containing gas is injected at the burner bottom via pipe 4 so that partial or total burning of the coke is achieved. The flue gas is separated in the burner cyclone 39. The burner is cooled by any suitable means for controlling the temperature up to a maximum of 750° C., but such cooling means may not be necessary since a separate coke stream is withdrawn continuously from purge outlet 38, especially when residue of very high CCR is processed. The preferred adsorbent in such operation is calcined coke and therefore it can be removed on a continuous basis from the apparatus which helps in maintaining the heat balance by minimizing the net heat generation in the overall process. The adsorbent after coke burning is recycled from the bottom of burner 47 via standpipe 6 and slide valve 7 to the bottom of the riser.

Lift steam is injected at the bottom of the riser through inlet point 25. Residue or poor quality feed is injected at inlet point 26 via primary feed nozzle so that the CCR, metals and other poisons existing in the residue feed are deposited on the adsorbent particles. The velocity is maintained in the riser sufficiently above the transport velocity of the adsorbent and catalyst to lift the adsorbent-catalyst mixture upwardly of riser 43 and eventually at catalyst inlet 23 of riser 43, the hydrocarbon which has been already vaporized and cleaned by the adsorbent, come in contact with the regenerated catalyst to accomplish the actual catalytic cracking reactions and in the process make sufficient vapor to further lift the catalyst, adsorbent and hydrocarbon mixture to the top of riser 43. An optional feed nozzle for riser 43 may be employed to inject relatively better quality feedstock or to control the riser temperature profile by allowing to inject quench stream e.g. heavy naphtha, heavy cycle oil etc. The hydrocarbon product is separated from the catalyst and adsorbent mixture at the top of the riser by employing known riser terminator devices and preferentially short contact high efficiency terminator 28A,28B. The product hydrocarbon vapor discharged through outlet 34 is withdrawn from the top of the reactor after passing through line 30, cyclone 31 and plenum 33 and the spent catalyst is striped in stripper 48 using stripping steam injected to the stripper at inlet point 40 and spent catalyst/adsorbent mixture is withdrawn via standpipe 2 and slide valve 3 to separator 44 to make the solid circulation continuous. The distance between the inlet of pipe 6 and inlet 23 in riser or riser reactor 43 should be 20 to 40% of the total riser length.

The major improvements achieved in our invention are summarized below:

(i) The separation of catalyst and adsorbent is done at low temperature in absence of any oxygen containing gas. The contact time of the catalyst in the separator is very less, since the catalyst particles are immediately transported through the lift line. Such unique separation significantly reduces the possibility of catalyst deactivation due to metals particularly vanadium. This also brings down the chances of vanadium mobility from the adsorbent to the catalyst phase.

(ii) The steam used in the separator helps in achieving better stripping of the strippable hydrocarbons carried by the catalyst in co-current pneumatic transport condition. Further, the steam and the ensuing hydrocarbon are removed from the catalyst using cyclone separators, before the catalyst is allowed to enter the regenerator. This unique scheme results into significantly reduced delta coke on the catalyst.

(iii) The adsorbent contacts first with the residue hydrocarbons at the riser bottom before contacting the catalyst particles. The adsorbent in the above mentioned process of contacting captures most of the metals, CCR and other poisons present in the residue and thereby helps to keep the catalyst relatively much cleaner from the above poisons. This greatly improves the overall performance of the catalyst and also brings down catalyst make up rate.

(iv) The CCR and metal laden adsorbent can be withdrawn as separate stream from the separator and the adsorbent burner. Such adsorbent may contain metals as high as 50000 ppm which could be used for extracting the high value vanadium and nickel from the adsorbent and if economics permit, recycle the rejuvenated adsorbent back to the adsorbent back to the adsorbent burner.

(v) In addition, if the residue feed contains very high CCR (above 5 wt %), any state of the art FCC process, will require enormous catalyst cooling to avoid the higher regenerator temperature. In contrast, our invention takes care of very high CCR quite efficiently. The adsorbent captures most of the feed CCR (about 90%) in the riser bottom. In such cases of high feed CCR, the preferred adsorbent is calcined coke so that a net coke stream can be withdrawn from the separator or the adsorbent burner. Such withdrawn coke stream could be used as feed for coke gassification/power or steam generation inside or outside the refinery. The adsorbent burner in such cases is required to burn only that much coke, which is sufficient to maintain the desired temperature of the recycle adsorbent to the riser. This unique feature of our invention allows the flexibility to process residue with very high CCR (even beyond 20 wt % of feed) without violating the overall heat balance of the unit. As well known in the current FCC art, avoiding the combustion of the total coke inside the battery limit of the unit, not only saves the capital investment on the burner but also helps to control the NOx and SOx emission of the unit.

Other benefits and details of the present invention are disclosed subsequently.

ADSORBENT

Adsorbent particles are intended to adsorb the CCR, the poisonous metals e.g. vanadium, nickel etc. basic nitrogen and sulfur rich compounds existing in enriched from the residual hydrocarbon fractions. Typically, adsorbent particles are having particle size in the range of 200–500 microns but preferably within 300–400 microns. The particles density may be kept between 1500–3000 kg/m$^3$ and preferably 1800–2600 kg/m$^3$ and most preferably 2300–2500 kg/m$^3$. The present invention also applied to adsorbent of particle size higher than 550 microns and density above 3500 kg/m$^3$ but the larger particle size and density pose flow problem in the standpipe and also in the regenerator.

The adsorbent particles mainly consist of the microspheres composed of alumina, silica alumina, silica magnesia, kaolin clay or a mixture there off having acidic properties or could be totally non acidic. These microspheres could be prepared using the conventional art of FCC catalyst preparation i.e. by preparing the solution of desired chemical composition, its spray drying and calcination. Typically, these materials have very less acidic cracking activity characterized by Mat activity of less than 15 and surface area of less than 5 m$^2$/gm. However, our invention is not limited to low activity adsorbent alone. For example, one may use the disposable spent catalyst from FCC/Residue FCC and hydro-processing units provided the particle size and density are within the specified range of the adsorbent as mentioned above. More details on the above said materials are available in U.S. Pat. No. 5,059,302.

For residues containing CCR above 4–5 wt %, we prefer that the adsorbent should be calcined coke produced from calcination of raw coke generated in the delayed coking process of petroleum residues. Coal particles or other types of coke are also applicable but calcined coke are preferred due to their excellent attrition resistance and physical properties e.g. higher particle density etc. Since, the present process produces a net coke stream for high CCR residue feedstock, stable coke particle having proper mechanical strength, size, shape and density as mentioned herein above, should be used. It may be noted that if the attrition resistance of the coke is not good, small coke fines will be generated which can not be separated in the condition of the dense bed separator device. These fines will thereby reach to the regenerator and increase its temperature beyond limit. Therefore, we prefer a mechanically stable calcined coke rather than raw coke. The other advantage of calcined coke is that it has higher density, lower sulphur content and lower volatile matters vis a vis raw coke.

Typical properties of calcined pertroleum coke is given below:

Ash content: 0.17 wt %

Sulfur : 1.04 wt %

Volatile matters (VM) : 0.33 wt %

Iron : 149 ppm

Vanadium : 3.8 ppm

Real density : 2.14 gm/cc

Bulk density : 0.73 gm/cc

Particle density : 1.52 gm/cc

Attrition resistance : 1.2 (division index)

The calcined coke was obtained from one delayed coker unit processing long reside of atmospheric column. This calcined coke was grinded mechanically to produce the desired particle size range between 200–350 microns. It may be noted that when calcined coke is used as the adsorbent, the major intention is to draw a separate stream of net coke from the separator/burner so that the unit heat balance is properly satisfied. Therefore, for safe reuse/disposal of the net coke drawn from the process of this invention, it is preferred to use calcined coke alone, whenever it is preferred, without adding any other adsorbent components as mentioned above.

For residue feedstock containing higher amount of vanadium (above 10 ppm) but having CCR less than 2 wt %, we prefer to use commercially available vanadium traps such as V-trap additive of M/s. Intercat USA. This could be used alone or in admixture with other adsorbent component as mentioned above except calcined coke. The concentration of Vanadium trap in the mixture of other absorbent component may vary from 0–100 wt % depending on the concentration of Vanadium in the feed, but usually 10–40 wt % is considered sufficient for feed having vanadium up to 50 ppm.

In case, the feed contains higher amount of both vanadium and CCR, we prefer to use calcined coke as the adsorbent, since calcined coke has also very good metal trapping ability. It may be noted that raw coke could be used in our application. But the calcined coke is preferred in our process. This is due the fact that our invention involves high velocity separation and riser operation with the adsorbent particles which demand good attrition resistance and relatively higher particle density. Calcined coke has very good attrition resistance which is equivalent to or better than even conventional FCC catalyst and its particle density is also more than raw coke. In general, it may be noted that all these particles should meet the requirements of particle size and/or particle density or both in order to achieve the maximum segregation efficiency in the separator.

Typical particle size distribution of the adsorbent particles are given below:

| wt % | Adsorbent Particle Size microns |
|---|---|
| 0 | 300 |
| 10 | 320 |
| 30 | 350 |
| 50 | 365 |
| 70 | 375 |
| 90 | 385 |
| 95 | 390 |
| 100 | 400 |

The adsorbent particles preferably should be microspherical in nature. However, the present invention is not limited to other shapes of particles.

CATALYST

Conventional state of the art commercial catalyst used in FCC technology, may be employed in this invention. However, the present invention specifically describes the particle size of the catalyst to be within 20–200 microns and more preferably 20–170 microns and most preferably 20–100 microns. Similarly, the particle density may be within 1200–1800 kg/m$^3$ and more preferably 1300–1600 kg/m$^3$ and most preferably within 1300–1400 kg/m$^3$ to obtain best results as disclosed in the present invention. Like adsorbents, catalyst should be preferably micro-spherical in shape. The present invention is not restricted to any particular type of FCC catalyst. Therefore, rare earth exchanged Y zeolite, Ultrastable Y zeolite, non crystalline acidic matrix and even other zeolites e.g. shape selective ZSM-5 zeolite may also be used. The present invention prefers to have no CO promoters since the both catalyst regenerators and adsorbent burner of the present invention should preferably run in partial combustion mode. However, our invention is not limited CO promoter usage particularly when the feed contains CCR lower than 2 wt %. Typical particle size distribution of the catalyst microspheres are:

| wt % | Adsorbent Particle Size microns |
|---|---|
| 0 | 20 |
| 10 | 40 |
| 30 | 70 |
| 50 | 80 |
| 70 | 95 |
| 90 | 105 |
| 95 | 110 |
| 100 | 120 |

FEEDSTOCK

The present invention provides a novel approach to handle residual hydrocarbons having very high CCR, metals and other poisons. Maximum benefit is obtained particularly if the metal level and CCR level of the feed are above 10 ppm and 5 wt % on feed respectively. Here, metal includes vanadium and nickel. It may be noted that our invention preferentially allow the CCR, metals and other poisons of the feed to deposit on the adsorbent first before contacting with the catalyst. Moreover, a net coke stream is withdrawn from the process which helps to maintain heat balance quite easily for feedstock with high CCR.

CATALYST SEPARATOR

The spent catalyst and adsorbent mixture enters the separator near middle of the elevation. The separator acts as a vessel to segregate the catalyst from the adsorbent particle. The separator works on the principle of difference of transport velocities among two types of particles i.e. catalyst and adsorbent. In the prior art, usually settling velocity difference has been employed for such separation. We have discovered now that the best segregation efficiently is achieved by utilizing the transport velocity difference which is further illustrated in Example-1 of the present invention.

Accordingly, in the preferred embodiment, the separator is having an entry line for the spent adsorbent-catalyst mixture and operating within a temperature range of 450–600° C. and preferably within 490–550° C., a specified superficial velocity range which is at least 20% above the transport velocity of the largest and heaviest catalyst particle but at least 30% lower than the transport velocity of the lightest and finest adsorbent particle, where in steam is injected at the bottom of the separator to maintain a dense fluidized bed of adsorbent and transporting the spent catalyst particles through a lift line having reduced diameter than that of the separator with additional stem injection points and withdrawing the adsorbent to the burner kept at lower elevation than the separator.

The most important feature of our separator device is that such high efficiency separation of catalyst is achieved using steam at low temperature. The steam in the separator serves many purpose and such low temperature separation gives following important benefits;

(i) lift the catalyst particles to the top of the separator lift line and maintain a dense bed of adsorbent inside the separator;

(ii) strip out the remaining hydrocarbons from the spent adsorbent and catalyst mixture in co-current transport regime at fairly low temperature. This reduces the delta coke on catalyst and adsorbent and at the same time minimizes the thermal cracking reactions which occur in high temperature and conventional counter current strippers with relatively larger contact time;

(iii) for high CCR (above 5 wt %) residue feed, it is possible to draw a relatively cooler stream of net coke from the separator while using calcined coke as adsorbent. Such low temperature adsorbent stream require less cooling requirement for its disposal or reuse. Most importantly, the net coke withdrawn helps to solve the high temperature problem associated with high CCR feed. Since the coke is withdrawn from the system, only that much heat is allowed to be generated from coke burning which is required to meet the reactor heat demend. The other advantage is that the costly treatment of flue gas could avoided since the flue gas $SO_x$ and $NO_x$ are considerably reduced in the present invention due to low temperature regeneration and removal of significant quantity of coke as separate stream without burning;

(iv) the separator can sometimes act as a dense bed to supply adsorbent to the riser bottom particular when the feed CCR is very low (less than 2 wt %) but metals in the feed are relatively higher. In such cases, adsorbent burner is to necessary and optional stream of hot regenerated catalyst from the regenerator may be added to the separator to maintain its temperature up to 600° C. maximum, so that hot adsorbent stream can be drawn from the separator bottom for recycling to the riser;

(v) The steam along with the hydrocarbons separated in the cyclone from the catalyst are reusable as stripping steam in the conventional catalyst stripper and or as lift steam/atomozation steam in riser bottom and feed nozzle or for similar applications in the process lines of riser/reactor/stripper section.

CATALYST REGENERATOR

The lifted catalyst from the separator is separated from the steam and ensuing hydrocarbons in a cyclone or a series of cyclones. The catalyst particles fall through the cyclone dipleg to the dense bed of the regenerator. In the present embodiment as shown in FIG. 2, superficial velocity is maintained typically within 0.5–1.0 m/s and more preferably within 0.6–0.8 m/s to have a conventional dense bed regeneration of the catalyst. However, our invention is also applicable to fast fluidized combustor or even two stage regenerator designs.

The excess air is maintained such that preferably partial combustion is achieved and the coke on regenerated catalyst is preferably less than 0.2 wt %. In the partial combustion mode, chances of vanadium deactivation of catalyst particles reduces significantly. Moreover, heat generation per unit of coke burnt also reduces resulting into higher catalyst to oil ratio in the unit. However, total combustion may also be employed along with the present invention where the regenerator temperature is kept with in the limit of 750° C. Since the feed CCR and metals are preferentially deposited on the adsorbent particles, we do not expect too much coke lay down on the catalyst. Therefore, it may not be difficult to keep the regenerator temperature within limit. It may be specifically mentioned that our invention does not require any catalyst cooling even while processing of high CCR feedstock. This is due to the selective deposition of CCR in the adsorbent high efficiency and low severity segregation of catalyst from adsorbent separate withdrawal of coke stream from the adsorbent separator and or burner for maintaining heat balance without requiring catalyst cooling.

ADSORBENT BURNER

The burner usually runs on the partial combustion mode under controller air flow in dense bed fluidzation regime. The coke burnt from the adsorbent is sufficient to maintain the burner temperature within 700° C. and most preferably within 600° C. The excess oxygen in the flue gas could be in the range 0–2 vol % and $CO/CO_2$ may vary in the range 0.2–10 vol/vol. There is not maximum limit on the coke on the adsorbent. Usually, it is observed that at higher concentration of coke on the adsorbent, the vanadium and CCR trapping ability of the adsorbent improves. However, for practical reasons, the coke content on the adsorbent is kept in the range of 0.3–2 wt %.

There is provision to withdraw a net stream of coke from the burner when the residue contains feed with CCR above 5 wt % and the preferred adsorbent in such case is calcined coke. This helps to process heavy CCR residue without violating the heat balance. The burner can also run in total combustion made, although it is not desirable from heat balance view point. The flue gas of the burner and the regenerator could be mixed together before sending to CO boiler or energy recovery section.

RISER

In this section, the adsorbent particles coming from burner or separator are first contacted with preheated heavy residual hydrocarbon in presence of lift steam. Typically, lift and feed atomization steam (about 10–50 wt % of feed may be added in the bottom section of the riser depending on the quality of residue particularly CCR content. The adsorbent/oil ratio and the steam/or ratio are varied in the following range:

| Feed CCR wt % | Typical Adsorbent/Residual oil | Steam/Residual oil |
|---|---|---|
| 3 | 3 | 0.3 |
| 5 | 4 | 0.5 |
| 7 | 5 | 0.7 |

The superficial velocity is maintained in the range of 6–10 m/s typically which will be sufficient to lift the adsorbent particles through the riser.

The regenerated catalyst is injected at the intermediate elevation of the riser. The catalyst/total hydrocarbon is kept normally in the range of 4–6 wt/wt to achieve best possible results. There is provision for injecting separate feed stream at the intermediate riser elevation above the entry point of the regenerated catalyst. Such feed should have CCR, metals and other poisons as less as possible but definitely lower than those of the residual stream injected at the riser bottom. Typical example of such cleaner streams are fresh vacuum gas oil, heavy cycle oil recycle etc. The riser top temperature and the intermediate temperature just below the catalyst entry point could be used to control catalyst/oil and adsorbent/residue ratios respectively through the corresponding slide valve. Total residence time in the riser bottom section could be 10–40% of the total riser residence time. The catalyst residence time in the riser may be maintained between 1–15 seconds and preferably between 3–8 seconds depending on the severity of the operation desired.

STRIPPER

Stripping steam may be injected at the bottom of the stripper and/or at different elevations to achieve better stripping efficiency. Usually, 2–5 tons per 1000 tons of solid flow is the normal rate of total steam flow in the stripper. One important aspect here is to maintain higher velocity of the stripping gas typically above 0.2 m/s so that the coarse particles are at least above the minimum fluidization velocity. Specially, in the standpipes and at the bottom of the stripper, steam purge is given to keep the adsorbent and the catalyst mixture flowable. Other non conventional stripping e.g. fas fluidized stripping, hot stripping etc. may also be adopted but not essential in the present invention. This is because, the catalyst separator also enhances stripping efficiency by co-current stripping with high velocity lift steam as described earlier.

EXAMPLE 1

This example illustrates the relationship of superficial bed velocity with the segregation efficiency of a dual solid system. A glass column with following design specification is used for the study.

| | |
|---|---|
| Column diameter | 3.5 inch |
| Column height from airentry point | 35.4 inch |
| Wall thickness | 0.196 inch |
| Disengage height above column | 12 inch |
| Disengager Diameter | 8 inch |

Sand is used in the size range of 220–320 microns with particle density of 2600 kg/m$^3$. Catalyst is in the size range of 40–150 microns with particle density of 1450 kg/m$^3$. Typically 800 gms of 50/50 by wt of sand and catalyst mixture is loaded and air is injected at the bottom of the column at different velocities. Solid sample is collected near bottom of the column just above the air entry point. The particles size distribution of the collected solid is done to establish amount of segregation that has taken place. For 100% segregation, the collected sample should contain no particle of size below 200 micron i.e. the cut off size between sand and catalyst. Following results are obtained when the air velocity is increased for a mixture with starting inventory of 800 grams of sand/catalyst mixture.

| superficial velocity (meters/sec) | segregation efficiency % |
|---|---|
| 0.65 | 47 |
| 0.72 | 58 |
| 0.79 | 69 |
| 0.86 | 76 |
| 0.92 | 80 |
| 1.02 | 84 |

it is found that increasing superficial velocity significantly improves the segregation efficiency. Superficial velocity with just above 1 meter/sec segregation of about 84% could be achieved. The other important observation is that beyond certain velocity, the segregation efficiency actually tapers off. This could be possibly due to the entrainment of lighter and relatively smaller fraction of the adsorbent with the transported catalyst particles. Therefore, it may be noted that the superficial velocity in the separator is to maintained such that is it sufficient to lift and transport even the heaviest and largest range of catalyst particles but distinctly insufficient to be able to lift the finest and lightest portion of adsorbent. In other words, the separator bed velocity should be above the transport velocity of the catalyst but lower than that of the adsorbent. For the size and density of the sand the catalyst as mentioned above in this example the transport and settling velocities are:

| | Settling velocity | Transport velocity |
|---|---|---|
| Catalyst | 0.2 | 1.3 |
| Sand | 1.8 | 3.5 |

Typically, for FCC catalyst particles having particle density of 1450 kg/m$^3$ the transport velocity variation with the average particle size is given below:

| average particle size (micron) | transport velocity (m/sec) |
|---|---|
| 100 | 1.5 |
| 150 | 2.0 |
| 200 | 2.3 |
| 250 | 2.8 |
| 300 | 3.5 |

As seen above, the variation in transport velocity with average particle size is quite significant and seen more prominent than the difference in their respective settling velocities. Therefore, the transport velocity difference is exploited in this invention to maximize the segregation efficiency between two types of particles.

This example illustrates that is the superficial velocity is maintained around 0.6–0.7 m/s as done in conventional dense bed regime, it is not possible to achieve more than 50–60% segreation efficiency. This example also highlights that the proper knowledge of the transport velocity of both adsorbent and catalyst particle is very essential to maximize the solid segregation efficiency of the separator.

EXAMPLE 2

This example illustrates the benefits of sequential dual solid processing particularly the vanadium deposition preferentially on the adsorbent particles and thereby improving the activity of the FCC catalyst.

For this purpose following samples were considered.

| | |
|---|---|
| Catalyst A | ReUSY (rare earth exchanged ultra stable Y) based FCC catalyst sample (commercially available from M/s, AKZO Nobel, the Netherlands in trade name Vision 56M) |
| Adsorbent | V-trap commercial additive from M/s, Intercat, USA. But with particle size in the range of 250–350 micron. |

Vanadium is first deposited (by adopting port volume impregnation route of Mitchell) at 0 and 10000 ppm on the mixture of catalyst A and adsorbent B mixed in the ratio of 10:0.6.

Typically the MAT activity was determined using MAT (micro activity test) condition of 510° C. reactor temperature, 2.5 grams solid loading, 30 seconds feed injection time and varying feed rate to generate date at different conversion level. Feed used is the combined feed used in one commercial FCC unit with CCR 0.4 wt %, boiling range 370–550° C., density of 0.91 gm/cc.

Thereafter, the Vanadium is deposited selectively on the adsorbent B at 0,10000 ppm using same pore volume impregnation technique. The metal laden adsorbent is then mixed with the catalyst A in the same ratio of 0.6:10. MAT activity and product selectivity were measured using the same feed with this solid mixture as performed in above.

For the sake of comparison, MAT studies were also done with only Catalyst A (without adding any adsorbent), both at 0 and 10000 ppm vanadium level.

Following results are obtained:

MAT ACTIVITY

Mat activity is defined as the conversation obtained at WHSV at 110 hour$^{-1}$ and conversion is defined as the wt % product boiling below 216° C. including coke.

| Vanadium level, ppm | Catalyst A | Vanadium deposited on Composite Catalyst & Adsorbent | Vanadium deposited only on Adsorbent |
|---|---|---|---|
| 0 | 38.6 | — | — |
| 10,000 | 10.1 | 16.5 | 37.5 |

COKE SELECTIVITY

Similarly, the coke selectivity changes with vanadium are given below, with both combined as well as sequential processing of solid. Here, coke selectivity is defined as the coke yield (wt % of feed) at 38 wt % conversion level.

| Vanadium level, ppm | Catalyst A | Vanadium deposited on Composite Catalyst & Adsorbent | Vanadium deposited only on Adsorbent |
|---|---|---|---|
| 0 | 1.87 | — | — |
| 10,000 | 5.93 | 3.62 | 1.9 |

It is observed here that is no adsorbent is used, vanadium at 10000 ppm concentration, brings down the conversion very significantly from 38.6 to to 10.1 unit, which improves to 16.5 when the adsorbent is used combined with the catalyst. However, when sequential vanadium deposition is done first on the adsorbent before mixing with the catalyst, the solid mixture shows almost the conversion as if no vanadium is there. Similar case is observed on the coke selectivity also. Sequential vanadium deposition on the adsorbent first is able to provide coke selectivity almost same as that of the catalyst without vanadium.

From the above, the importance and advantage of first depositing vanadium selectively on the adsorbent is clearly observed. There has been remarkable retention of the catalyst activity, coke and other product selectivity if the Vanadium is preferentially deposited on the adsorbent first before getting in contact with the actual catalyst.

What is claimed is:

1. A fluidized catalytic cracking apparatus, comprising:

a riser containing regenerated catalyst and adsorbent and having:

first inlet means for introduction of high velocity steam, second inlet means for introduction of a feed stream containing heavy residual fractions with high concentrations of conradson coke, metals including vanadium and nickel, and additional poisons including nitrogen, third inlet means for introduction of the adsorbent, and fourth inlet means disposed above the third inlet means for introduction of the regenerated catalyst, the adsorbent having a particle size which is larger than that of the regenerated catalyst;

a stripper into which the riser extends for causing separation of a hydrocarbon fraction from spent catalyst and adsorbent;

a separator connected to the stripper and having a base, an inlet at the base for introduction of steam in the upward direction so as to provide a transport velocity in the upward direction for the spent catalyst and cause a separation of the particles of the spent catalyst from the adsorbent in use;

a regenerator connected to the separator and having an outlet and being to flow communication with the fourth inlet for introduction of the regenerated catalyst into the riser;

a burner for receiving the adsorbent from the separator and causing a regeneration thereof, the burner having an inlet for introduction of oxygen containing gas and on outlet in flow communication with the third inlet for introduction of the adsorbent into the riser; and a lift line which is connected between the separator and the regenerator for allowing a flow of the spent catalyst from the separator into the regenerator while leaving the adsorbent within the separator in a fluidized condition, the lift line having a plurality of steam inlets disposed at different elevations along its length for introduction of steam to provide said transport velocity.

2. The apparatus as claimed in claim 1, wherein the catalyst has a particle size ranging from 20 to 200 $\mu$m and a density in the range of 1200 to 1800 kg/m$^3$.

3. The apparatus as claimed in claim 1, wherein the adsorbent has a particle size ranging from 200 to 500 $\mu$m and a density ranging from 1500 to 3000 kg/m$^3$.

4. The apparatus as claimed in claim 1, wherein the riser has a length, and wherein the third and fourth inlets are separated by a distance which ranges from 20 to 40% of the length of the riser.

5. the apparatus as claimed in claim 1, wherein the burner is disposed below the separator.

* * * * *